US005107732A

United States Patent [19]

Hanmer

[11] Patent Number: 5,107,732

[45] Date of Patent: Apr. 28, 1992

[54] SEVERING APPARATUS

[76] Inventor: Peter B. Hanmer, PO Box 7033, Gold Coast Mail Centre, Qld., Australia, 4217

[21] Appl. No.: 540,206

[22] Filed: Jun. 19, 1990

Related U.S. Application Data

[63] Continuation-in-part of Ser. No. 340,176, Apr. 14, 1989, abandoned.

[30] Foreign Application Priority Data

Dec. 9, 1986 [AU] Australia ..... PH7973
Nov. 9, 1987 [AU] Australia ..... PCT/AU87/00311
Apr. 18, 1990 [AU] Australia ..... PJ9668

[51] Int. Cl.[5] ..... B26D 7/14
[52] U.S. Cl. ..... 83/175; 83/649
[58] Field of Search ..... 83/175, 649, 456; 225/26, 77, 80, 85, 90; 30/124

[56] References Cited

U.S. PATENT DOCUMENTS 2,582,979 1/1952 Fritzinger ..... 83/649 X
3,311,278 3/1967 Brandon ..... 225/93
3,370,497 2/1968 Busse ..... 83/649 X
4,196,647 4/1980 Fish ..... 83/175
4,417,495 11/1983 Gordon et al. ..... 83/175
4,488,466 12/1984 Jones ..... 83/175

FOREIGN PATENT DOCUMENTS 503352 8/1979 Australia .
1407507 9/1975 United Kingdom .

*Primary Examiner*—Frank T. Yost
*Assistant Examiner*—Eugenia A. Jones
*Attorney, Agent, or Firm*—Fleit, Jacobson, Cohn, Price, Holman & Stern

[57] ABSTRACT

Apparatus for severing sheet material which includes pairs of upper and lower jaws which may be moved towards each other to grip and tension sheet material disposed between the jaws. An elongated severing blade is arranged between one of the pairs of jaws, the latter normally being biased to a position where they conceal the blade but being movable against the bias when engaged by the other jaws to expose the severing blade for severing of the tensioned sheet material.

13 Claims, 5 Drawing Sheets

SEVERING APPARATUS

CROSS REFERENCE TO RELATED APPLICATIONS

This application is a continuation-in-part application of application Ser. No. 07/340,176 filed Apr. 14, 1989, now abandoned.

FIELD OF THE INVENTION

This invention relates to severing apparatus which is suited to severing of sheet material and which has particular application to dispensers for severing and dispensing a length of material from a roll such as plastics material, foil or paper material.

DESCRIPTION OF THE RELATED ART

Plastics sheet material, paper sheet material or foil for use by consumers is usually carried on a cylindrical former and stored inside a container or carton having a closure flap which may be opened to expose the sheet material. The carton has a serrated knife edge adjacent an edge of an opening formed when the closure flap is opened. The material is unrolled from the former and once a suitable length thereof is unrolled it is drawn across the knife edge and that length is severed from the remainder.

It is necessary with such a carton to prevent the roll of material from rotating during the severing operation. Thus, the operation requires two hands. If the roll is not held against rotation it is usually not possible to produce a transverse edge which extends at ninety degrees across the sheet material and this is undesirable.

Where sheet material is flexible plastics sheet material (such as plastics food wrap), even if the roll is held against rotation the material has a tendency to gather up or fold onto itself during or as a consequence of the severing operation. One then either needs to straighten or unfold the material before it can be used for its intended purpose which is frustrating and time consuming or throw away that severed length of material and have another attempt at severing a length of material which is wasteful.

In another earlier proposal, of which Australian patent specification 503352 is typical, a web roll dispenser is proposed. The carton in which the roll is purchased is discarded (regardless whether or not it has a serrated knife, like that previously described) and the roll is placed into a dispenser from which discrete lengths of material can be severed from the roll. Such dispensers are provided primarily for aesthetic reasons and consist of a container body with a lid or cover and has an elongated opening through which the material can be withdrawn. A straight edge is provided adjacent the opening and the material can be drawn across the edge to sever a length of material from the roll. If the roll within the dispenser is not restrained against rotation during the severing operation, it is not possible to sever the material at ninety degrees transversely thereacross and a ragged edge is sometimes obtained.

Such dispensers are generally more suited to material such as paper or foil but where the material is plastics film there is an even greater tendency to produce a ragged edge during the severing operation. This is because the film is flexible and can be stretched and is usually stretched during the severing operation. In addition to the production of a ragged edge, if care is not exercised the film, because of its nature will tend to fold over on itself and will need to be unfolded before it can be used.

In an attempt at alleviating the problems referred to above, sometimes the straight edge across which the material is drawn has been replaced with a serrated knife. The resultant dispenser then becomes nothing more than an upmarket replacement for the packaging container initially discussed above.

In U.K. patent specification 1407507 a dispenser and joiner is disclosed having a container for rotatably receiving a roller of plastics film. The container has a lid and the film is captured between the lid and an upper edge of the container during a severing operation in which the lid is held closed against the container. A knife is movably held by the lid and can be moved along the lid to sever a discrete length of material from the roll. Thus, a two part operation is involved. As the material is stretched by the movement of the knife there is a tendency for the roll to rotate within the container. This, because of the construction of the dispenser either makes the severing operation difficult or results in an edge on the severed length (and also on the leading edge of the material extending from the roll) being at something other than at ninety degrees to side edges of the material.

A further dispenser is disclosed in U.S. Pat. No. 4,417,495, this dispenser including jaws which clamp the material at spaced apart portions and a blade between the jaws serves to sever the material between the jaws. Slipping of the material in this apparatus, however, is a problem and as the material is not held under tension efficient severing is not always achieved.

SUMMARY OF THE INVENTION

It is an object of the present invention to provide severing apparatus for severing sheet material which at least minimizes some of the disadvantages referred to above. It is also an object of the invention to provide a dispenser for dispensing material from a roll which incorporates such severing apparatus.

According to one preferred aspect of the invention, there is provided severing apparatus for sheet material, said apparatus including a first pair of spaced apart elongated jaw members, a second pair of spaced apart elongated jaw members, respective said jaw members of said first pair being adapted for co-operation with respective said jaw members of said second pair, mounting means for mounting said pairs of jaw members for movement relatively towards and away from each other, elongated severing means disposed between the jaw members of one said pair of jaw members, said jaw members of said one pair being mounted on said mounting means for movement between a first position concealing said severing means and a second position exposing said severing means, and characterized in that when said first and second pairs of jaw members are moved towards each other, the respective said co-operable jaw members cooperate to apply a tension to sheet material in the region between said co-operating jaw members in a direction transverse of said jaw member, said jaw members of said one pair thereafter moving to said second position to expose said severing means for severing said material tensioned between said first and second pair of cooperating jaw members.

In one preferred form, on jaw member of said first pair co-operates with a corresponding jaw member of said second pair to hold said material therebetween, the other said jaw member of said first pair cooperates with the corresponding member of said second pair so as to tension said material longitudinally of the material between said co-operating jaw members, said jaw members of said one pair thereafter moving to said second position to expose said severing means for severing said material tensioned between said co-operative jaw members.

Preferably, said jaw members of said one pair are mounted for independent movement on said mounting means for movement between said first and second positions. Suitably, biasing means are provided for biasing said jaw members of said one pair to said first position, said jaw members being movable against the bias of said biasing means to said second position.

Preferably, said jaw members of said first pair are fixed relatively to each other and wherein said severing means is disposed between said jaw members of said second pair.

In a further preferred form, the jaw members are configured such that they co-operate when moved towards each other to engage said sheet material and apply a tension to said sheet material without any outside influence on the material. For this purpose, the jaw members may formed such that the jaw members of said first pair effectively slide along the jaw members of the second pair such that the material held therebetween is tensioned longitudinally across the receiving space or recess for the severing means between said co-operating jaw members. To achieve this stretching or tensioning action, the jaw members of one pair may be configured to move outwardly or inwardly as they slide along the jaw members of the other pair which for example may include outwardly diverging surfaces.

Suitably, the severing apparatus is incorporated in dispensing apparatus, said dispensing apparatus including receiving means for holding a supply or roll of material, support means extending along said receiving means and against which a transverse portion of the material may locate, holding means adjacent said support means and biased relative thereto to hold the material therebetween, said severing means being disposed adjacent said holding means and said support means.

It is usual for the supply of material to consist of a roll of material carried on a cylindrical former. The invention will be described by way of example with reference to a roll of material. The material may be paper or paper based, metal foil such as aluminum foil or plastics material such as food wrap or plastics material for other purposes.

The receiving means may include a surface upon which the roll of material may rest. Alternatively, the receiving means may include spindle portions which locate within open ends of the cylindrical former which carries the roll of material. In a preferred form of the invention the receiving means may comprise an elongate body within which the roll may be placed and a cover normally extending over the body. The body may have one or more retaining walls which substantially enclose the roll. Preferably, the body has a wall upon which the roll may rest. If desired, the wall may be a bottom wall of the body and be shaped or contoured to conform to the peripheral contour of the roll. Preferably the bottom wall is U or V shaped.

The body may be provided with an opening through which the roll may be placed. For example, the body need not completely surround or enclose the roll. Alternatively, the cover may be removable or movable to enable the roll to be placed within the body. Preferably the body is substantially U shaped in transverse cross section. This shape has two side walls and a bottom wall which may all form one continuous wall of the body and two end walls. One side wall may for example be hinged relative to the bottom wall and in this way the roll of material may be positioned with the body.

If desired the body, in use may be hand held or wall or surface mounted. Where the body is wall or surface mounted it is preferred that the body be provided with mounting means to facilitate this. The mounting means may comprise adhesive pads secured to the body portion. Alternatively fixing apertures for receiving fasteners may be present through the body. In another form mounting brackets or plates or the like may form part of the body or be secured thereto.

The body may be adapted to be free standing on a support surface in which case one surface of the body may merely rest upon the support surface. Alternatively the body may have outwardly projecting legs upon which it may rest on the support surface. Preferably at least two legs are present. These legs may project downwardly from the body at two transversely spaced locations along.

Preferably the cover is hinged to an edge of the body and may be moved from a position enabling a roll of material to be placed in the body to a position covering the body.

The dispenser includes jaw carriers mounted for movement relative to one another. The jaw carriers include upper and lower jaw carriers. The upper carrier has jaw members extending along it. Preferably the jaw members are at a free edge of the carrier. The jaw members on one carrier are substantially complementary in shape to the members on the other carrier. In one embodiment, the members on the upper carrier comprise two spaced rails having a recess between them. The rails extend outwardly from the carrier and are directed towards the members on the other carrier. The free edges of the members of the upper carrier are contoured to receive the members of the lower carrier.

The upper carrier may be pivotally mounted relative to the cover whilst the lower carrier may be fixed to the body. Preferably, the upper carrier is normally urged away from the lower carrier.

The members on the lower carrier define a recess between them in which the severing means locates. These members normally conceal the blade and are movable, when the upper carrier pivots downwardly to engage and move the lower jaw members to uncover the blade. The members on the lower carrier have contoured free ends receivable by the jaw members of the upper carrier.

The support means extends substantially the full length of the dispenser. The support means may comprise an outwardly directed or upstanding ledge or finger upon which a transverse portion of the material may locate. In one embodiment, the support finger has two arms which are pivotally mounted. The pivotal mounting may be relative to the body. Preferably the finger is biased away from the lower jaw carrier. The biasing may be achieved by a leaf spring mounted on the body. Preferably the finger has a curved transverse profile and when viewed in plan, has an outwardly curved rear or trailing edge. Such a profile and edge assists in ensuring that the material does not crease or fold over on itself when drawn across the finger.

The holding means extends substantially the full length of the dispenser. The holding means normally abuts the support means and material is captured or held between them so that a free edge of the material may be readily retrieved from the dispenser after a severing operation. The holding means may comprise a holding finger extending between two spaced arms. The arms may be pivotally mounted to enable the holding finger to move relative to the support finger. Preferably the holding finger is pivotally mounted to the cover and preferably the holding finger is preferably curved in transverse cross-section to match the curve of the support finger.

The severing means suitably includes a cutting member which in one embodiment extends transversely across the material. The cutting member may extend adjacent the support means or the holding means and be movable between a retracted or non-cutting position to an extended or cutting position. The cutting member may be caused to move from the retracted to the extended position as a consequence of co-operation between the upper and lower jaw carriers. Preferably the cutting member is brought into contact with the material as it is stretched or tensioned between the co-operating jaw members. Preferably the cutting member is an elongate cutting blade. Preferably the cutting blade has a plurality of triangular outwardly extending cutting teeth for engaging the material. The teeth may first pierce the material and then cut the material as the blade is moved into the material. The blade may be mounted relative to the jaw members of the lower carrier.

BRIEF DESCRIPTION OF THE DRAWINGS

The invention will now be described by way of example with reference to the drawings in which.

DETAILED DESCRIPTION OF THE INVENTION

Figure 1:
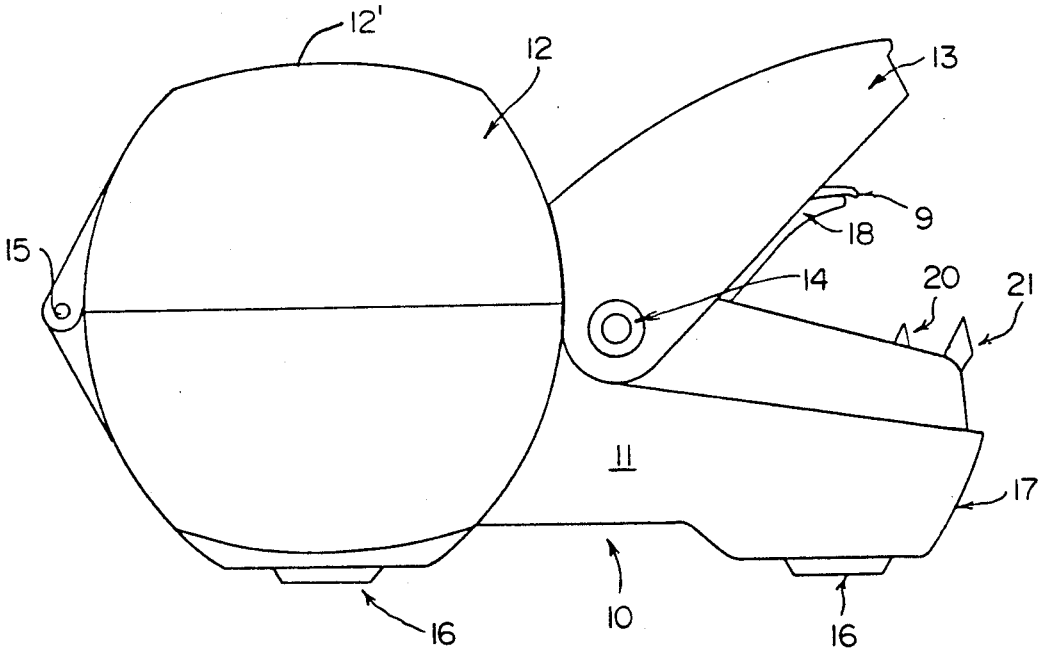
FIG. 1 is an end view of a dispenser incorporating severing apparatus according to an embodiment of the invention showing the dispenser in its closed position.

Referring to the drawings and firstly to FIG. 1 there is illustrated a dispenser 10 according to the invention, the dispenser 10 including a body 11 and a cover 12. The cover 12 includes a main housing 12' and an upper jaw carrier 13 pivotally coupled to the housing 12' via a pivot connection 14 whilst the cover 12 is pivotally coupled to the body 11 via hinges 15. The body 11 has downwardly extending lands 16 upon which the body 11 may rest on a support surface (not shown). The dispenser 10 in FIG. 1 is shown in its rest position with jaw carrier 13 pivoted away from the forward end 17 of the body 11. Visible between carrier 13 and forward end 17 of the body 11 are holding means for the material comprising co-operative lower and upper holding members 18 and 19 respectively. Supported on the body 11 adjacent the forward end 17 of the body 11 are inner and outer jaw members 20 and 21 which in the FIG. 1 attitude extend slightly above the forward end 17 of the body 11.

Figure 2:
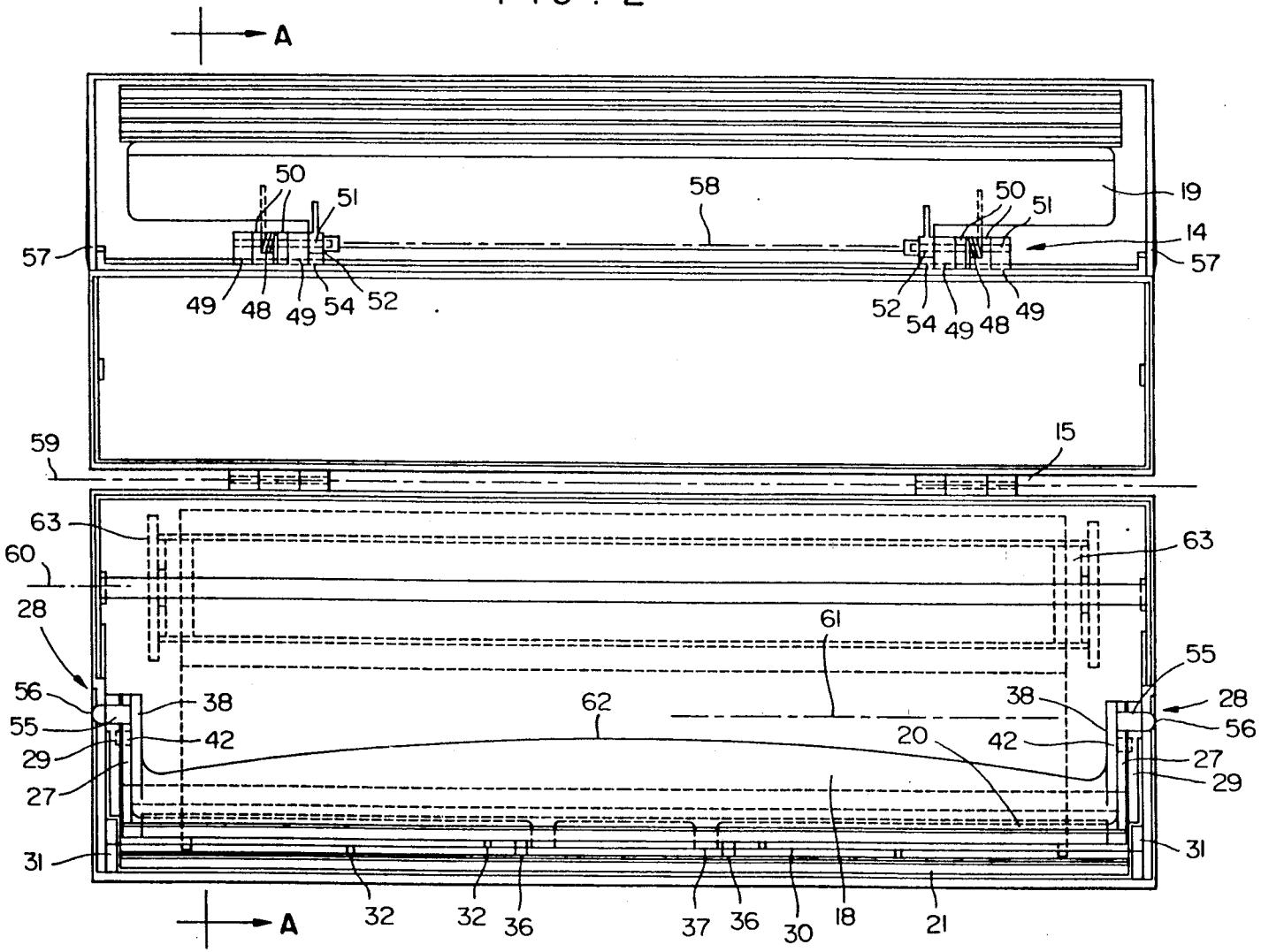
FIG. 2 is a plan view of the dispenser of FIG. 1 in an open position.
Figure 3:
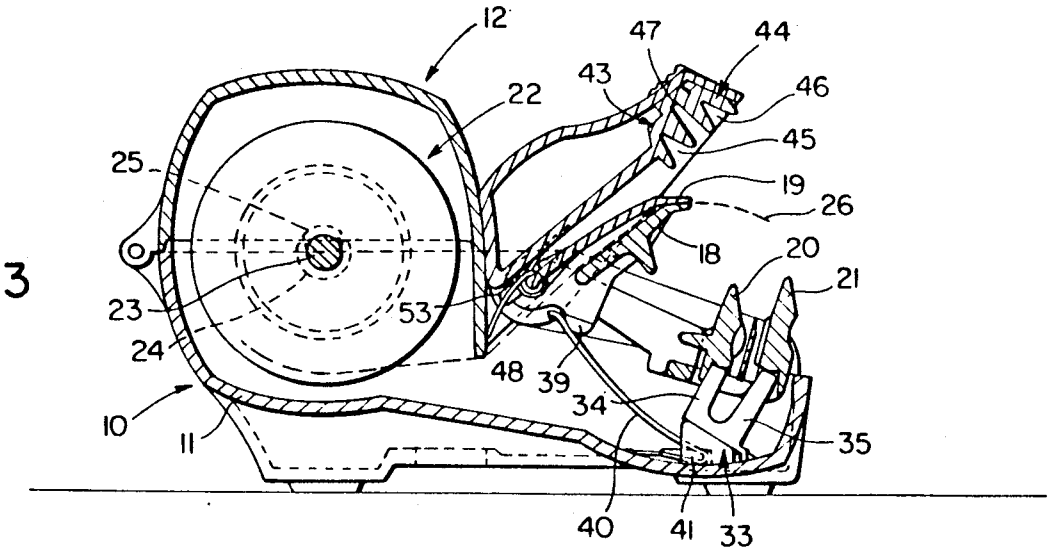
FIG. 3 is a sectional view of the dispenser of FIG. 2 when closed taken along lines A—A of FIG. 2.

Referring now to FIG. 3 which illustrates further details of the dispenser 10 in its closed attitude, a roll of material 22 is held within the dispenser 10 and normally concealed from view by the cover 12. The roll of material 22 is supported on an axle 23 which is seated at opposite ends in respective U-shaped saddles 24 on the body 11. When the cover 12 is closed arcuate members 25 on the cover 12 co-operate with the axle 23 to hold the axle 23 in the saddles 24. A free edge 26 of the roll of material 22 passes out between the upper and lower holding members 19 and 18 and may readily be grasped by a user. A pair of arms 27 are fixed to opposite ends of the jaw members 20 (see FIG. 2), and pivotally mounted to the base 11 via a pivot connection 28 defining a pivot axis extending generally parallel to the jaw member 20. A further pair of arms 29 are connected to opposite ends of the jaw member 21 and are also mounted to the base 11 via the pivot connection 28. The jaw members 20 and 21 are thus independent of each other and free for individual pivotal movement about the pivotal connection 28. The jaw member 21, however, extends upwardly of the jaw member 20 and both jaw members 20 and 21 have tapered distal ends forming a generally wedge shaped profile. An elongated blade 30 extends longitudinally between the members 20 and 21 and is anchored or fixed between opposite side faces of the dispenser base 11 by means of anchoring blocks 31. The blade 30 is stationary relative to the body 11 and concealed between members 20 and 21 when in the rest position of FIG. 3. The blade 30 (although not shown) preferably has a serrated cutting profile with upstanding saw teeth. To maintain the blade 30 centrally between the jaws 20 and 21, the jaws 20 and 21 are provided with respective opposite guides or tabs 32 which maintain the blade 30 at a fixed spacing from the jaws 20 and 21.

Respective leaf spring assemblies 33 (see FIG. 3) are supported on the base 11 and engage the underside of the respective jaws 20 and 21, the leaf spring assemblies 33 comprising respective leafs 34 and 35 which engage the underside of the respective jaws 20 and 21 so that the jaws 20 and 21 are independently biased upwardly. The jaws 20 and 21 are provided with respective lugs 36 and 37 which normally abut the underside of the blade 30 to limit upward movement of the jaws 20 and 21.

The lower holding member 18 is also supported by a pair of opposite arms 38 which are pivotally connected to the base 11 via the pivot connections 28. The arms 38 include on their underside lobes 39 which are engaged by leaf springs 40 serving to normally bias the arms 38 in an upward direction. The leaf springs 40 are secured at one end to the base 11 at 41. The lobes 39 further include extended lugs 42 which normally abut the underside of the arms 27 to limit their upward movement.

The upper jaw carrier 13 includes a pair of spaced apart fixed jaw members 43 and 44 which extend outwardly therefrom and extend from one side of the dispenser to the other. Both jaw members 43 and 44 are provided with V or U-shaped grooves or recesses 45 and 46 which are complementary to the tapered wedge shaped profile of the members 20 and 21. The jaw members 43 and 44 are spaced apart to be separated by a recess 47 so as to receive the blade 30 when the dispenser is actuated. Springs 48 at the pivotal connection 14 normally bias the upper carrier 13 to the FIGS. 1 and 3 position.

The upper holding member 19 is pivotally mounted to the upper jaw carrier 13 at the pivotal connection 14 and is free for limited pivotal movement as described further below.

Figure 4:
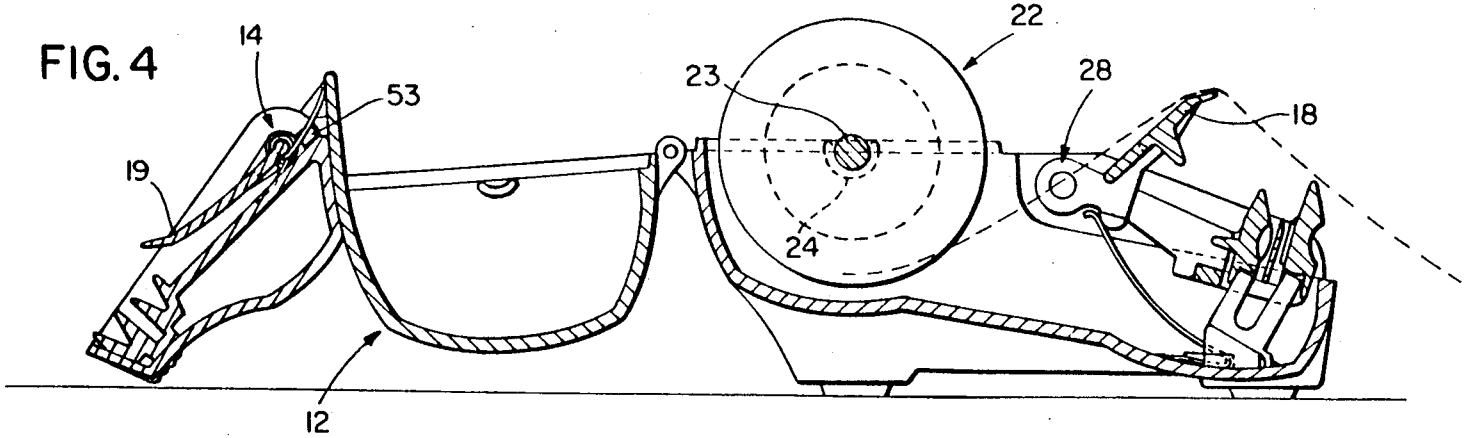
FIG. 4 is a sectional view of the dispenser in the FIG. 2 position but taken along the same sectional lines as that in FIG. 3.

In use and as shown in FIG. 4 the free edge 26 of the material to be severed is initially fed out over the holding member 18 and thereafter the cover 12 is closed so that the member 19 is urged towards engagement with the member 18 so that the sheet material from the roll 22 is sandwiched therebetween. In this position, the pivot connection 14 is in axial alignment with the pivot connection 28. The length of material to be severed from the roll 22 is then drawn out of the dispenser 10 and the jaw carrier 13 is then pressed downwardly.

Figure 7:
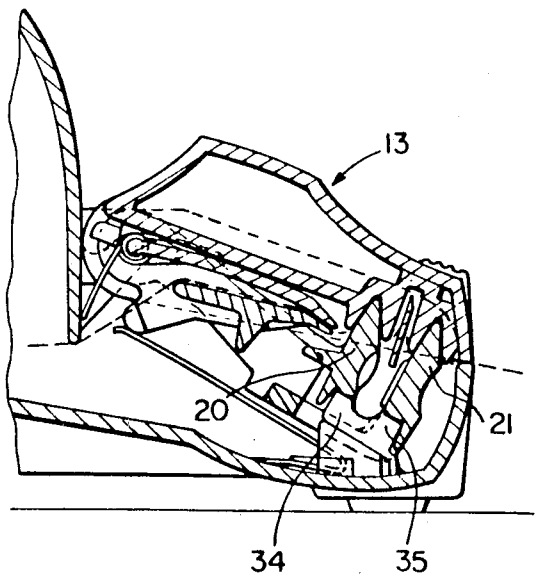
FIGS. 5 to 7 illustrate stages in the operation of the severing apparatus of the invention.
Figure 6:
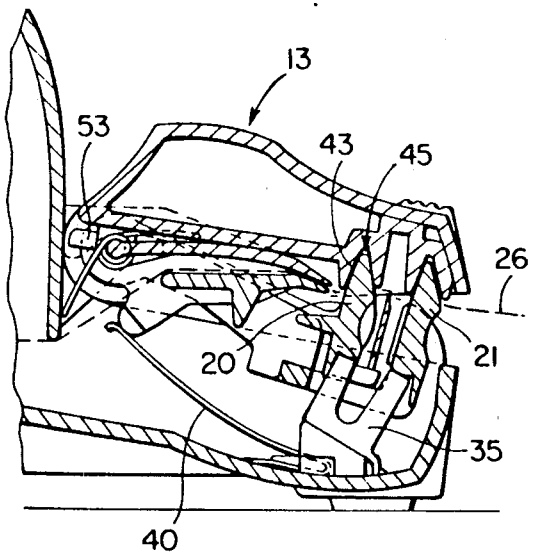
Figure 5:
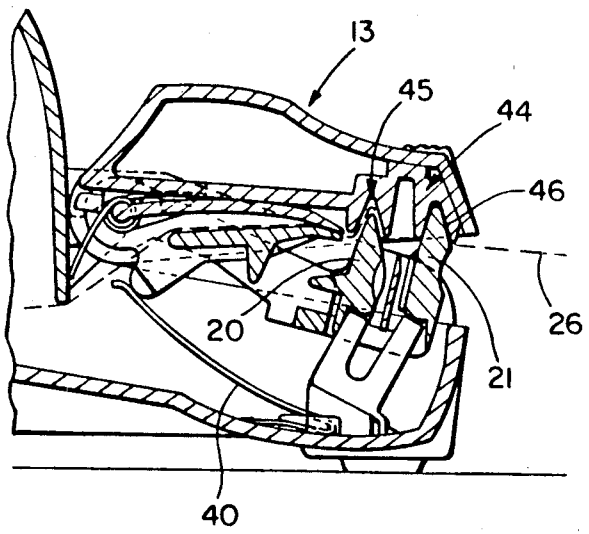

As shown in FIG. 5 the jaw member 21 firstly moves into the recess 46 of the jaw member 44 so that the material is firmly gripped therebetween. Between the position of FIGS. 3 and 4, the holding members 18 and 19 sandwich the material and then remain stationary with movement thereof being opposed by the spring 40. Further downward movement of the carrier 13 results in the carrier 13 abutting against the holding member 19 which with the member 18 then pivot downwardly with the carrier 13. Furthermore, downward movement of the jaw carrier 13 causes the material held between the members 18 and 19 and co-operating jaw members 44 and 21 to be forced by the jaw member 20 into the recess 45 of the jaw member 43. During this movement the jaw member 21 moves downwardly against the bias of the leaf spring 35 whilst the jaw member 20 maintains its position until it seats firmly within the recess 43. This action causes the material between the jaw members 20 and 21 to be stretched or tensioned over the recess 47 as shown in FIG. 6. Further downward movement of the jaw carrier 13 causes both jaw members 20 and 21 to be pushed downwardly against the bias of the spring leafs 34 and 35 and the blade 30 to engage and sever the stretched material as shown in FIG. 7. Thereafter the jaw member 13 is released permitting the spring 48 to move it back to the position of FIG. 3 and the severed sheet material to be released.

To load or reload the dispenser with a roll 22 of material to be severed the cover 12 is hinged open about pivots 14 so that the dispenser is in the FIG. 4 position. The roll 22 is placed in the rear of the body 11 and the free end 26 is withdrawn from the roll and trained over the holding member 18. The dispenser may then be returned to the FIG. 3 position and is now ready for use.

With further reference to FIGS. 2, it can be seen that the pivot 14 is formed by opposite lugs 49 and 50 on the cover 12 and jaw carrier 13 respectively which are interconnected via pivot pins 51. The springs 48 are located about the pivot pins 51 to urge the jaw carrier 13 to an open position. The pivot pins 51 also engage lugs 52 on the holding member 19 to define the pivot connection for the holding member 19. The member 19 also includes lugs 53 which co-operate with lugs 54 on the cover 12 to limit clockwise pivotal movement of the member 19 from the position of FIG. 3 but permit anticlockwise movement back into engagement with the carrier 13 as shown in FIGS. 6 and 7.

The pivotal connection 28 for the jaws 20 and 21 and holding member 18 is defined by pivot pins 55 on the ends of the arms 38 which project through apertures in the arms 27 and 29 and side walls of the dispenser base 11. The projecting end 56 of the pins 55 are rounded to form a detent for positively positioning the carrier 13, the carrier 13 for this purpose suitably including dimples 57 aligned with the pivots 14 which latch over the ends 56 of the pins 55 when moved to the FIG. 3 position.

With reference to FIG. 2, axis 58 represents the axis about which jaw carrier 13 and holding member 19 may pivot. Axis 59 is the axis about which the cover 12 pivots relative to the body 11. Axis 60 is the central axis of rotation of roll 22 as material is withdrawn therefrom and axis 61 is the axis about which the arms 27 and 29 and holding member 18 pivot, the axis 61 being aligned with the axis 58 when the cover 12 is closed.

Preferably the trailing edge 62 of the holding member 18 is arcuate or curved so as to be broader in the region between the sides of the dispenser. Such a construction assists in preventing the material gathering up on itself as it is withdrawn from the roll.

It will be appreciated that the dispenser may be made in a variety of sizes to accomodate a variety of differently sized rolls or alternatively may be adapted to receive plugs 63 which locate in ends of the roll 22. The support member 18 extends almost the full length of the dispenser and may be thought of as a support finger. Because this finger is biased upwardly by leaf spring 41 (FIG. 5) after a severing operation a free edge of the material is presented raised for easy retrieval by the user. The holding member or finger 19 holds the material down against finger 18 to ensure that the free end is not lost. The cooperating jaw members however may be of other complementary shapes.

In an alternative configuration of apparatus, the jaws 20 and 21 may be fixed in position and the jaws 43 and 44 independently spring loaded or otherwise biased to an inoperative position with the blade 30 being fixed therebetween. In this arrangement, the severing mechanism will function as described above with the outer opposite jaws initially cooperating to grip the material and the inner opposite jaws serving to stretch or tension the material prior to severing by the blade. Of course in this case, the blade is exposed on retracting movement of the upper jaws against their bias.

The jaw members 20, and 21 are of complementary wedge shape to the recesses 45 and 46 of the jaw members 43 and 44 ensure that maximum grip is afforded for minimum effort. The co-operative jaws 20, 21, 43 and 44 may also have polished surfaces to enhance the clamping and gripping effect of the jaws. Plastic film tends to cling to polished surfaces and thus use of such surfaces in the gripping jaws tends to improve the gripping efficiency of the jaws.

Figure 8:
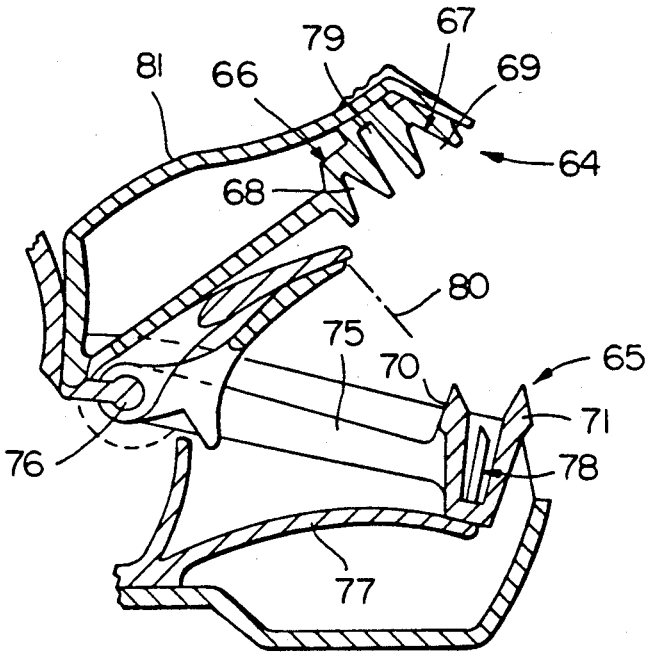
FIG. 8 illustrates the opposite jaw members of a further form of severing apparatus according to the invention.
Figure 9:
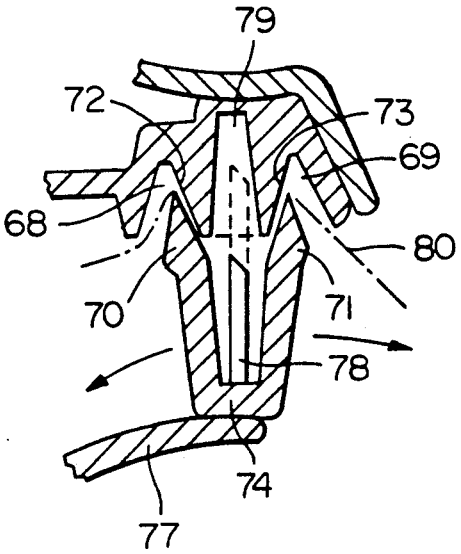
FIG. 9 illustrates operation of the jaw members of the embodiment of FIG. 8.

Referring now to FIGS. 8 and 9 there illustrated the jaws of an alternative embodiment of severing apparatus which is similar in many respects to the previous embodiment and which includes a pair 64 of upper jaw members and an opposing pair 65 of lower jaw members with the jaw members 66 and 67 of the upper pair defining wedge shaped recesses 68 and 69 whilst the jaw members 70 and 71 of the lower pair have a complementary wedge shaped profile for co-operation with the recesses 68 and 69. The wedge shaped members 70 and 71 are spaced apart relative to the recesses 68 and 69 such that when the pairs of jaw members 64 and 65 are moved towards each other, the respective members 70 and 71 initially contact the inner inclined surfaces 72 and 73 of the recesses 68 and 69 as shown in FIG. 9 so as to slide therealong which causes the jaw members 70 and 71 to cam outwardly as shown by the arrows until they seat neatly within the recesses 68 and 69. Preferably, the members 70 and 71 are biased to a normal undeflected position shown in FIG. 8 so as to be moved outwardly against the bias when moving into the recesses 68 and 69. For this purpose, the jaw members 70 and 71 may be interconnected by an integral web 74 which permits resilient movement of the jaws 70 and 71 as described above. Alternatively, the jaw members 70 and 71 may be pivotally mounted and biased to the FIG. 8 position by means of springs or other biasing means.

The jaw members 70 and 71 are mounted on an arm 75 for pivotal movement about an axis 76 and downwardly against the bias of a leaf spring 77. An elongated blade 78 is disposed between the jaw members 70 and 71 and fixed to the body of the severing apparatus. The jaw members 66 and 67 define therebetween a recess 79 for receipt of the blade 78 as described below.

In use the sheet material 80 to be severed is draped over the jaw members 70 and 71 after which the jaw members 66 and 67 which are fixed to a pivotal jaw carrier 81 are pivoted downwardly so that the jaw members 70 and 71 move into the recesses 68 and 69 as shown in FIG. 9. The material 80 is sandwiched between the respective jaw members 70 and 71 and the surfaces 72 and 73 so that as the jaw members 71 move further into the recesses 68 and 69, their sliding wedging action along the surfaces 72 and 73 causes the material 80 to be stretched or tensioned across the recess 79 in a generally longitudinal direction. This sliding wedging action is accompanied by outward deflection of the respective jaw members 70 and 71 against the inherent bias provided by the connecting web 64. When the jaw members 70 and 71 seat firmly within the recesses 68 and 69 the jaw members 70 and 71 will be moved downwardly against the bias of the spring 77 so as to expose the cutting blade 78 which severs the material tensioned or stretched across the recess 79 as it moves into the recess 79 as shown in dotted outline in FIG. 9. As before the jaw carrier 81 is normally biased to the position of FIG. 8 so that when the severing action is completed it may be released to permit the severed section of sheet material to be removed.

The jaws may be in other configurations and for example in a further embodiment one jaw member 70 may co-operate with the recess 68 to apply a clamping action to the material whilst the other jaw member 71 slides along the surface 73 so as to tension the material across the recess 79. Alternative co-operating wedging arrangements may also be provided to ensure that the material is tensioned across the recess 79. For example one or both wedge shaped jaw members 70 and 71 may be configured for engaging the outer inclined surfaces of the recesses 68 and 69 to apply a tension to the material. A similar cooperative jaw arrangement to that described above may also be used in the embodiment of FIGS. 1 to 7 so that a tensioning or stretching action on the material to be severed is also achieved through the sliding cooperative nature of the jaws.

The blade for either embodiment may be made of plastics material or metal and by having saw tooth serration and the way in which the material is held ensures that the blade cuts and does not tear the material. Since the blade is normally concealed it is not exposed where it may cause injury.

The severing apparatus may be used for cutting any sheet material which can be tensioned and or stretched and may be incorporated into dispensing apparatus as above or used in any other application.

I claim:

1. A severing apparatus for sheet material, including:

a first pair of spaced apart elongated jaw members, a second pair of spaced apart elongated jaw members, jaw members of one pair defining recesses complementary to jaw members of the other pair, respective jaw members of the one pair being arranged to cooperate with respective jaw members of the other pair, mounting means for supporting the pairs of jaw members for relative movement towards and away from each other, and elongated severing means, disposed between independently movable jaw members of one of said first and second pairs of jaw members, for cutting the sheet material, the independently movable jaw members being mounted on said mounting means for independent movement relative to each other and between first positions concealing said severing means and second positions exposing said severing means, said jaw members being mounted on said mounting means such that when said first and second pairs of jaw members are moved towards each other with said sheet material located between said first pair of jaw members and said second pair of jaw members, one jaw member of said first pair initially moves into one of said recesses so as to cooperate with a corresponding jaw member of said second pair to grip said material, one of the cooperating jaw members being one of said independently movable jaw members, the one of the cooperating jaw members, upon gripping said material, thereafter moving relative to the other of the independently movable jaw members so that the other jaw member of said first pair subsequently moves into another of said recesses, until it seats firmly within the other of said recesses, so as to force said sheet material into the other of said recesses and thereby applies a tension to said material, in a direction transverse of said jaw members, in a region between the recesses, the jaw members of said first and second pairs thereafter gripping and holding said material under tension, said independently movable jaw members then being moved simultaneously into their second positions to expose said severing means, said severing means thereby engaging the material, to which the tension is applied, in said region to sever the material.

2. A severing apparatus according to claim 1, wherein said jaw members of said first pair are supported for pivotal movement about an axis spaced from and extending substantially parallel to said jaw members.

3. A severing apparatus according to claim 1, and further including biasing means for biasing said jaw members of said first pair to said first positions, said jaw members being movable against the bias of said biasing means to said second positions.

4. A severing apparatus according to claim 1, wherein said jaw members of the second pair of jaw members are fixed relative to each other.

5. A severing apparatus according to claim 1, and further including biasing means for independently biasing said jaw members of said first pair to said first positions.

6. A severing apparatus according to claim 5, wherein said one jaw member of said first pair extends outwardly beyond the other jaw member of said first pair, and wherein said jaw members of said second pair of jaw members are fixed relative to each other.

7. A severing apparatus according to claim 6, wherein said one jaw member of said first pair, upon cooperating with said corresponding jaw member of said second pair, moves away from its first position against the bias of said biasing means to permit the other jaw member of said first pair to cooperate with the other of the recesses and move away from its first position.

8. A severing apparatus according to claim 1, wherein said jaw members of said first pair have wedge shaped profiles, and wherein said recesses are in said jaw members of said second pair and are of complementary wedge shaped cross section.

9. A severing apparatus according to claim 1, wherein said severing means comprises an elongated blade.

10. In combination, a dispensing apparatus and a severing apparatus according to claim 1, said dispensing apparatus including receiving means for supporting a roll of said sheet material to be severed, and holding means extending longitudinally of said roll and said jaw members for holding a free edge of said material therebetween.

11. The combination according to claim 10, wherein said holding means includes first and second co-operable holding members cooperating to hold said material therebetween, the combination further comprising biasing means for urging said holding members towards each other.

12. The combination according to claim 11, and further including a housing, said housing comprising first and second pivotally interconnected housing parts supporting said first and second pairs of jaw members, respectively.

13. The combination according to claim 12, wherein the first and second housing parts pivotally support said first and second holding members.

* * * * *